US009574424B2

(12) United States Patent
Armistead et al.

(10) Patent No.: US 9,574,424 B2
(45) Date of Patent: Feb. 21, 2017

(54) PRE-TENSING SECTIONS OF CONCENTRIC TUBULARS

(71) Applicants: George Taylor Armistead, Katy, TX (US); Alvaro Jose Arrazola, Houston, TX (US)

(72) Inventors: George Taylor Armistead, Katy, TX (US); Alvaro Jose Arrazola, Houston, TX (US)

(73) Assignee: CHEVRON U.S.A. INC., San Ramon, CA (US)

( * ) Notice: Subject to any disclaimer, the term of this patent is extended or adjusted under 35 U.S.C. 154(b) by 760 days.

(21) Appl. No.: 13/971,350

(22) Filed: Aug. 20, 2013

(65) Prior Publication Data

US 2015/0053406 A1 Feb. 26, 2015

(51) Int. Cl.

| | |
|---|---|
| ***E21B 36/00*** | (2006.01) |
| ***E21B 17/04*** | (2006.01) |
| ***E21B 23/01*** | (2006.01) |
| ***E21B 17/18*** | (2006.01) |

(52) U.S. Cl.

CPC ..... *E21B 36/00* (2013.01); *E21B 17/04* (2013.01); *E21B 17/18* (2013.01); *E21B 23/01* (2013.01); *E21B 36/003* (2013.01)

(58) Field of Classification Search

CPC ..... E21B 36/00; E21B 17/04; E21B 17/18; E21B 23/01; E21B 36/003

See application file for complete search history.

(56) References Cited

U.S. PATENT DOCUMENTS

| | | | | |
|---|---|---|---|---|
| 3,647,245 | A | 3/1972 | Hanes | |
| 3,687,196 | A * | 8/1972 | Mullins | E21B 23/01 166/217 |
| 4,415,184 | A | 11/1983 | Stephenson | |
| 4,456,069 | A | 6/1984 | Vigneri | |
| 4,477,106 | A * | 10/1984 | Hutchison | E21B 17/00 138/149 |
| 4,518,175 | A | 5/1985 | Richards | |

(Continued)

FOREIGN PATENT DOCUMENTS

GB 2158537 11/1985

OTHER PUBLICATIONS

International Search Report for PCT/US2014/046614, mailed Feb. 24, 2015.

*Primary Examiner* — Robert E Fuller
*Assistant Examiner* — David Carroll
(74) *Attorney, Agent, or Firm* — King & Spalding LLP

(57) ABSTRACT

A method for pre-tensing sections of concentric tubulars in a wellbore. The method can include mechanically coupling an inside tubing pipe to an inside tubing string disposed in the wellbore. The method can also include mechanically coupling a second tubing to a second tubing string disposed in the wellbore. The method can further include suspending, by the first tubing, the first tubing, the first tubing string, the second tubing string, and the second tubing. The method can also include inserting, while suspending the first tubing, the first tubing string, the second tubing string, and the second tubing by the first tubing, a first slip into the first space between the first tubing and the second tubing. The method can further include inserting the first tubing, the first tubing string, the second tubing string, the second tubing, and the first slip further into the wellbore.

20 Claims, 4 Drawing Sheets

(56) References Cited

U.S. PATENT DOCUMENTS

| | | | | |
|---|---|---|---|---|
| 4,566,495 | A * | 1/1986 | Baker | E21B 17/00 138/109 |
| 4,673,652 | A * | 6/1987 | McStravick | E21B 17/00 138/149 |
| 4,793,383 | A | 12/1988 | Gyory | |
| 4,823,919 | A * | 4/1989 | Hayatdavoudi | E21B 19/10 188/244 |
| 5,224,540 | A * | 7/1993 | Streich | E21B 29/00 166/118 |
| 2002/0023751 | A1 * | 2/2002 | Neuroth | E21B 23/14 166/302 |
| 2007/0012450 | A1 * | 1/2007 | Uttley | E21B 43/122 166/302 |
| 2009/0071652 | A1 * | 3/2009 | Vinegar | E21B 36/04 166/303 |
| 2010/0038898 | A1 | 2/2010 | Ollier | |
| 2010/0314103 | A1 | 12/2010 | Crossley | |
| 2011/0117467 | A1 * | 5/2011 | Katano | H01M 8/04089 429/442 |
| 2012/0175007 | A1 | 7/2012 | Pan | |

* cited by examiner

PRE-TENSING SECTIONS OF CONCENTRIC TUBULARS

CROSS-REFERENCE TO RELATED APPLICATIONS

The present application is related to a patent application titled "Downhole Construction of Vacuum Insulated Tubing," having U.S. patent application Ser. No. 13/942,024 and filed on Jul. 15, 2013, the entire contents of which are hereby incorporated herein by reference.

TECHNICAL FIELD

The present application relates to pre-tensing sections of tubing, and in particular, methods and systems of pre-tensing sections of concentrically arranged tubulars in a subterranean wellbore.

BACKGROUND

Tubing that is run into a finished wellbore (i.e., a wellbore in which casing is run) can be subject to a number of conditions in an effort to perform a field operation within the wellbore. For example, an operator may inject steam through the tubing to heat production fluid toward the bottom of the wellbore. Under some of these conditions, the tubing can expand and/or contract (as with temperature changes). Failing to allow for expansion or contraction of the tubing can result in damage to other equipment and/or interruption of a field operation. Similarly, building in allowances for expansion and contraction of the tubing can add significant costs to a field operation.

SUMMARY

In general, in one aspect, the disclosure relates to a method for pre-tensing sections of concentric tubulars in a wellbore. The method can include mechanically coupling an inside tubing string to an outside tubing string as the inside tubing string and the outside tubing string are run into the wellbore. The method can also include mechanically coupling an inside tubing pipe to the inside tubing string disposed in the wellbore. The method can further include mechanically coupling an outside tubing pipe to the outside tubing string disposed in the wellbore, where the inside tubing pipe is positioned inside a first cavity of the outside tubing pipe to form a first space between the inside tubing pipe and the outside tubing pipe. The method can also include suspending, by the inside tubing pipe, the inside tubing string, the outside tubing string, and the outside tubing pipe. The method can further include inserting, while suspending the inside tubing string, the outside tubing string, and the outside tubing pipe by the inside tubing pipe, a first slip into the first space between the inside tubing pipe and the outside tubing pipe. The method can also include inserting the inside tubing pipe, the inside tubing string, the outside tubing string, the outside tubing pipe, and the first slip further into the wellbore.

In another aspect, the disclosure can generally relate to a system for pre-tensing sections of concentric tubulars. The system can include an inside tubing string disposed, at least in part, within a wellbore. The system can also include an outside tubing string disposed, at least in part, within the wellbore, where the inside tubing string is disposed inside of the outside tubing string, where the outside tubing string is mechanically coupled to the inside tubing string, where the outside tubing string has an inner diameter that is greater than an outer diameter of the inside tubing string. The system can further include field equipment that detachably couples to a top end of the inside tubing string and suspends the inside tubing string and the outside tubing string. The system can also include at least one slip disposed between the inside tubing string and the outside tubing string while the field equipment suspends the inside tubing string and the outside tubing string. The at least one slip can hold the inside tubing string under tension when the field equipment releases the inside tubing string and the outside tubing string. The at least one slip can be made of a thermally non-conductive material.

These and other aspects, objects, features, and embodiments will be apparent from the following description and the appended claims.

BRIEF DESCRIPTION OF THE DRAWINGS

The drawings illustrate only example embodiments of methods, systems, and devices for pre-tensing sections of concentric tubulars in a wellbore (also called herein a "borehole") and are therefore not to be considered limiting of its scope, as pre-tensing sections of concentric tubulars in a wellbore may admit to other equally effective embodiments. The elements and features shown in the drawings are not necessarily to scale, emphasis instead being placed upon clearly illustrating the principles of the example embodiments. Additionally, certain dimensions or positionings may be exaggerated to help visually convey such principles. In the drawings, reference numerals designate like or corresponding, but not necessarily identical, elements. Designations such as "first", "second", and "third" are merely used to show a different feature. Descriptions such as "top", "bottom", "distal", and "proximal" are meant to describe different portions of an element or component and are not meant to imply an absolute orientation.

DETAILED DESCRIPTION OF EXAMPLE EMBODIMENTS

Figure 1:
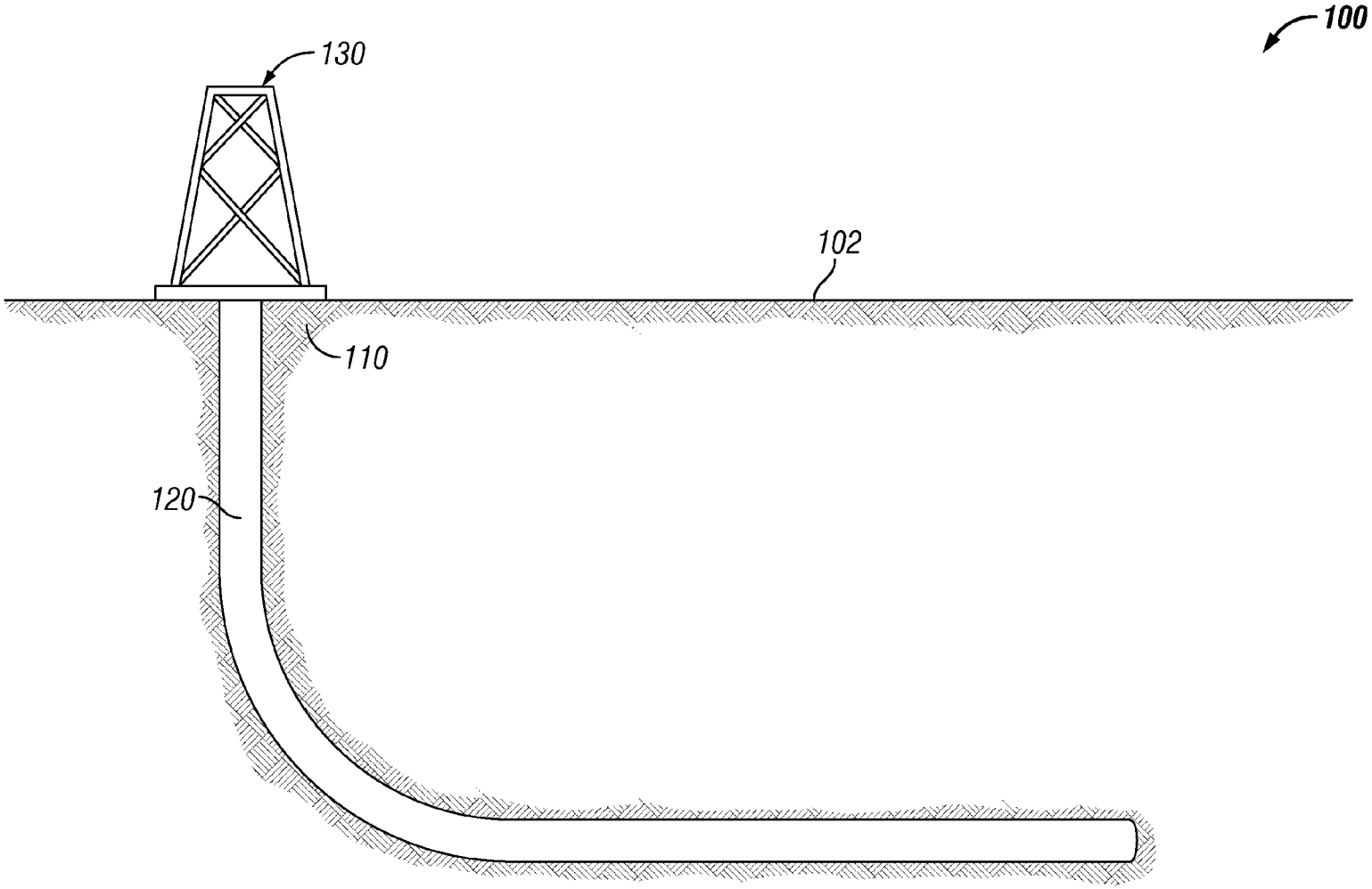
FIG. 1 shows a schematic diagram of a field system in which pre-tensed sections of concentric tubulars can be used in a wellbore in accordance with certain example embodiments.

Example embodiments directed to pre-tensing sections of concentric tubulars in a wellbore will now be described in detail with reference to the accompanying figures. Like, but not necessarily the same or identical, elements in the various figures are denoted by like reference numerals for consistency. In the following detailed description of the example embodiments, numerous specific details are set forth in order to provide a more thorough understanding of the disclosure herein. However, it will be apparent to one of ordinary skill in the art that the example embodiments herein may be practiced without these specific details. In other instances, well-known features have not been described in detail to avoid unnecessarily complicating the description.

As used herein, a length, a width, and a height can each generally be described as lateral directions. Terms such as, for example, "first," "second," "distal," "proximal," "inside," and "outside" are used merely to distinguish one component (or part of a component) from another. Such terms are not meant to denote a preference or a particular orientation.

In certain example embodiments, production fluid as described herein is one or more of any solid, liquid, and/or vapor that can be found in a subterranean formation. Examples of a production fluid can include, but are not limited to, crude oil, natural gas, water, steam, and hydrogen gas. Production fluid can be called other names, including but not limited to downhole fluid, reservoir fluid, a resource, and a field resource.

A user as described herein may be any person that is involved with extracting and/or controlling one or more production fluids in a wellbore of a subterranean formation of a field. Examples of a user may include, but are not limited to, a company representative, a drilling engineer, a tool pusher, a service hand, a field engineer, an electrician, a mechanic, an operator, a consultant, a contractor, a roughneck, and a manufacturer's representative.

As used herein a working fluid can be used to describe any liquid or vapor that has a temperature that is higher (in some cases, significantly higher) than the temperature of a production fluid in a wellbore. The working fluid can be sent into the wellbore and transfer heat to the production fluid in the wellbore. By heating the production fluid, the production fluid can be extracted from the wellbore more easily because the viscosity decreases. An example of a working fluid is high-temperature steam.

FIG. 1 shows a schematic diagram of a field system 100 in which pre-tensed sections of concentric tubulars can be used in a subterranean wellbore in accordance with one or more example embodiments. In one or more embodiments, one or more of the features shown in FIG. 1 may be omitted, added, repeated, and/or substituted. Accordingly, embodiments of a field system should not be considered limited to the specific arrangements of components shown in FIG. 1.

Referring now to FIG. 1, the field system 100 in this example includes a wellbore 120 that is formed in a subterranean formation 110 using field equipment 130 above a surface 102, such as ground level for an on-shore application and the sea floor for an off-shore application. The point where the wellbore 120 begins at the surface 102 can be called the entry point. The subterranean formation 110 can include one or more of a number of formation types, including but not limited to shale, limestone, sandstone, clay, sand, and salt. In certain embodiments, a subterranean formation 110 can also include one or more reservoirs in which one or more resources (e.g., oil, gas, water, and steam) can be located. One or more of a number of field operations (e.g., drilling, setting casing, extracting production fluids) can be performed to reach an objective of a user with respect to the subterranean formation 110.

The wellbore 120 can have one or more of a number of segments, where each segment can have one or more of a number of dimensions. Examples of such dimensions can include, but are not limited to, a size (e.g., diameter) of the wellbore 120, a curvature of the wellbore 120, a total vertical depth of the wellbore 120, a measured depth of the wellbore 120, and a horizontal displacement of the wellbore 120. The field equipment 130 can be used to create and/or develop (e.g., create a vacuum within, insert a working fluid into, extract production fluids from) the wellbore 120. The field equipment 130 can be positioned and/or assembled at the surface 102. The field equipment 130 can include, but is not limited to, a derrick, a tool pusher, a clamp, a tong, drill pipe, a drill bit, a slip, a vacuum system, an injection device, completion equipment, centralizers, tubing pipe (also simply called tubing), a power source, a packer, and casing pipe (also simply called casing).

The field equipment 130 can also include one or more devices that measure and/or control various aspects (e.g., direction, pressure, temperature) of a field operation associated with the wellbore 120. For example, the field equipment 130 can include a wireline tool that is run through the wellbore 120 to provide detailed information (e.g., curvature, azimuth, inclination) throughout the wellbore 120. Such information can be used for one or more of a number of purposes. For example, such information can dictate the size (e.g., outer diameter) of a casing pipe to be inserted at a certain depth in the wellbore 120.

Figure 2:
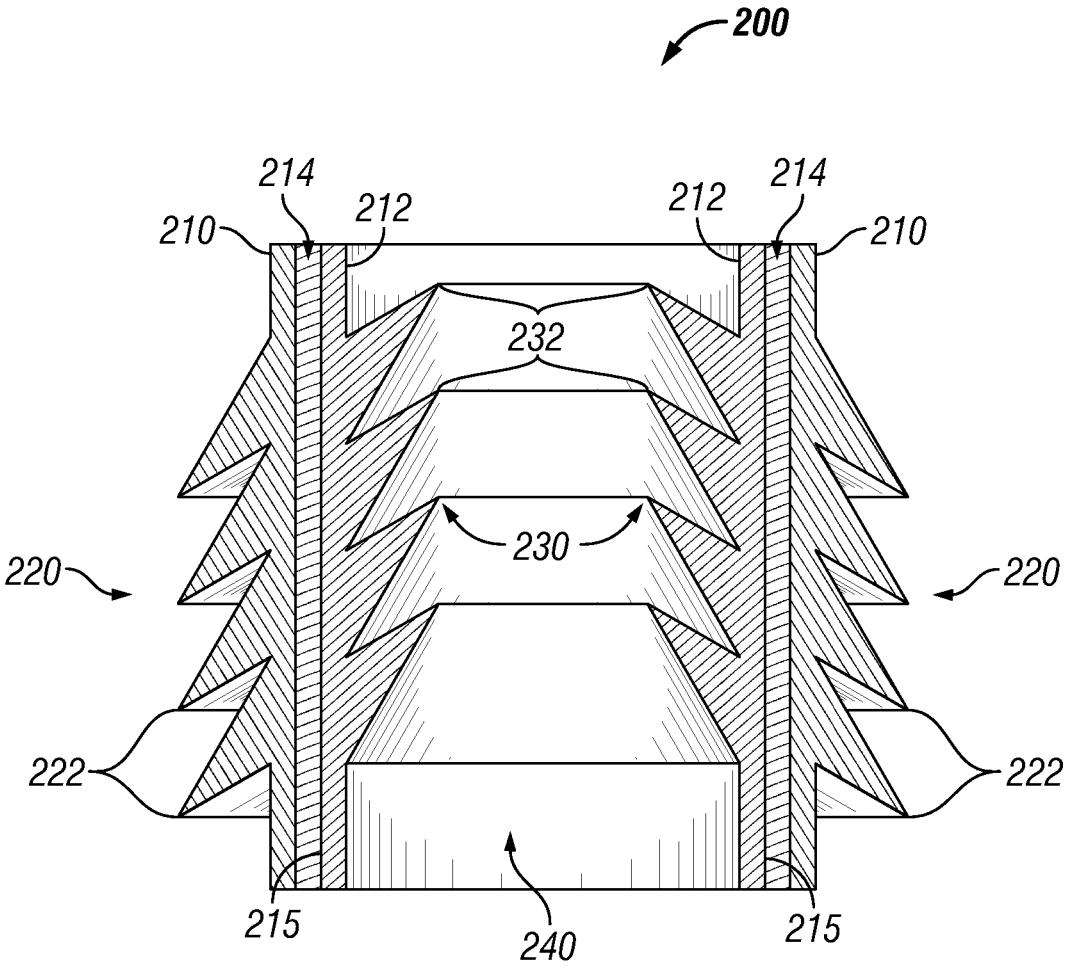
FIG. 2 shows a cross-sectional side view of a slip that can be used for pre-tensing sections of concentric tubulars in a wellbore in accordance with certain example embodiments.

FIG. 2 shows a cross-sectional side view of a slip 200 that can be used for pre-tensing sections of concentric tubulars in a wellbore in accordance with certain example embodiments. In one or more embodiments, one or more of the features shown in FIG. 2 may be omitted, added, repeated, and/or substituted. Accordingly, embodiments of a slip should not be considered limited to the specific arrangements of components shown in FIG. 2.

The example slip 200 of FIG. 2 can have a cylindrical shape that includes an inner surface 212 and an outer surface 210. The inner surface 212 forms a cavity 240 that traverses the height of the slip 200. Along the inner surface 212 and within the cavity 240 can be disposed one or more of a number of inner slip features 230. Each inner slip feature 230 can be fixed to or retractable on the inner surface 212. An inner slip feature 230 can be made from one or more of a number of hard materials, including but not limited to ceramic, steel, and titanium. Each of the inner slip features 230 can include one or more of a number of tooth-like projections 232 that can grip into the outer surface 314 of the tubing 310, as described below with respect to FIG. 3.

In certain example embodiments, the inner slip features 230 are oriented in such a way that the tubing that contacts the inner slip features 230 is prohibited from moving in one direction (in this case, downward) while being free to move in the opposite direction (in this case, upward). In other embodiments, the inner slip features 230 are oriented to prevent the tubing that contacts the inner slip features 230 from moving in any direction.

Along the outer surface 210 can be disposed one or more of a number of outer slip features 220. Each outer slip feature 220 can be fixed to or retractable on the outer surface 210. An outer slip feature 220 can be made from the same or different materials as the inner slip features 230. Each of the outer slip features 220 can include one or more of a number of tooth-like projections 222 that can grip into the inner surface 322 of the tubing 320, as described below with respect to FIG. 3.

In certain example embodiments, the outer slip features 220 are oriented in such a way that the tubing that contacts the outer slip features 220 is prohibited from moving in one direction (in this case, upward) while being free to move in the opposite direction (in this case, downward). In such a case, the outer slip features 220 and the inner slip features 210 can be bidirectional. In other embodiments, the outer slip features 220 are oriented to prevent the tubing that contacts the outer slip features 220 from moving in any direction.

The inner slip features 230 and/or the outer slip features 220 can operate using an engagement mechanism. In other words, the inner slip features 230 and/or the outer slip features 220 can be retracted (e.g., fully, partially) until an engagement mechanism is activated, at which point the inner slip features 230 and/or the outer slip features 220 can become extracted and engage the outer surface 314 of the tubing 310 and/or the inner surface 322 of the tubing 320, respectively. Such an engagement mechanism can be activated based on one or more of a number of factors, including but not limited to a pressure applied, an amount of weight, a movement, and a signal received remotely.

The slip 200 can include one or more features that allow air flow to pass therethrough, even if the inner slip features 230 and/or the outer slip features 220 are engaged with tubing. For example, air can pass along a space created by the inner slip features 230 and/or the outer slip features 220. As another example, one or more passages 214 can traverse a length of the slip 200, providing a passage for air. Each passage 214 can be defined by a wall 215. The body of the slip 200, defined by the inner surface 212 and the outer surface 210, can be made of one or more of a number of materials that allow the slip 200 to substantially maintain its shape when large amounts of force are applied against the inner slip features 230 and/or the outer slip features 220. In addition, some or all of the slip 200 (such as the body (the inner surface 212, the outer surface 210) of the slip 200) can be made of a thermally non-conductive material. An example of such materials can include, but is not limited to, ceramic.

The body of the slip 200, the inner slip features 230 and/or the outer slip features 220 can be made from a single piece (as from a mold) and/or from multiple pieces that are mechanically coupled together using one or more of a number of coupling methods. Examples of such coupling methods can include, but are not limited to, mating threads, welding, compression fittings, and fastening devices.

Figure 3:
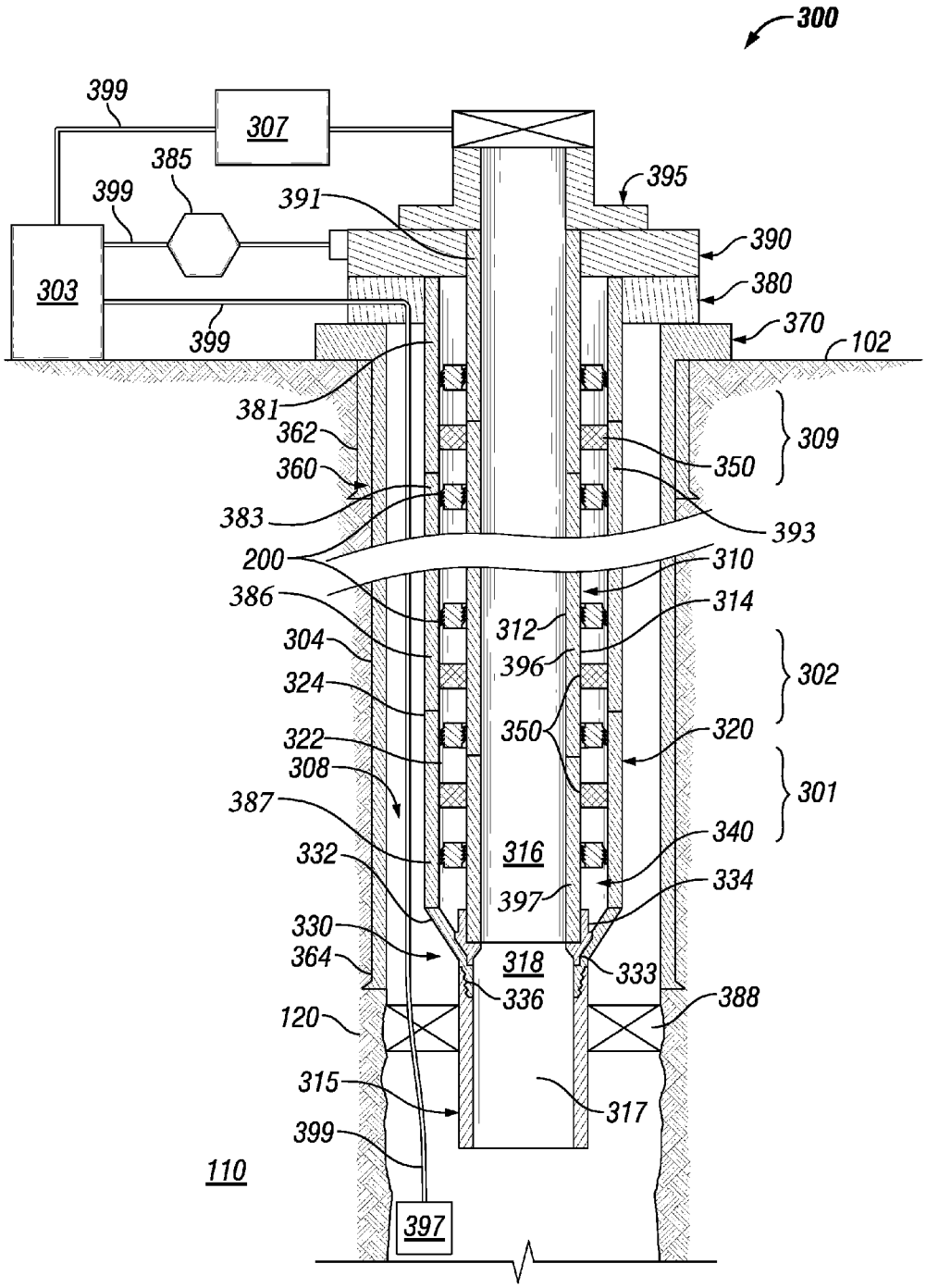
FIG. 3 shows a schematic diagram of a system with pre-tensed sections of concentric tubulars in a wellbore in accordance with certain example embodiments.

FIG. 3 shows a schematic diagram of a system 300 with pre-tensed sections of concentric tubulars in a wellbore in accordance with certain example embodiments. In one or more embodiments, one or more of the features shown in FIG. 3 may be omitted, added, repeated, and/or substituted. Accordingly, embodiments of a system should not be considered limited to the specific arrangements of components shown in FIG. 3.

The system 300 of FIG. 3 can include the casing 360 (e.g., casing 362, casing 364), the tubing (e.g., tubing 310, tubing 315, tubing 320), a multiple connection bushing 330, and a number of slips 200. Referring to FIGS. 1, 2, and 3, the casing 360 can include a number of casing pipes that are mechanically coupled to each other end-to-end, usually with mating threads. The casing pipes of the casing 360 can be mechanically coupled to each other directly or using a coupling device, such as a coupling sleeve.

Each casing pipe of the casing 360 can have a number of different sections that each have a length and a width (e.g., outer diameter). For example, casing 362 is positioned in the wellbore 120 closer to the surface 102 and is wider than casing 364, which is positioned further into the wellbore 120. Each section of casing 360 can include a number of casing pipes. The length and/or width of a casing pipe can vary. For example, a common length of a casing pipe is approximately 40 feet. The length of a casing pipe can be longer (e.g., 60 feet) or shorter (e.g., 10 feet) than 40 feet. The width of a casing pipe can also vary and can depend on the cross-sectional shape of the casing pipe. For example, when the cross-sectional shape of the casing pipe is circular, the width can refer to an outer diameter, an inner diameter, or some other form of measurement of the casing pipe. Examples of a width in terms of an outer diameter can include, but are not limited to, 7 inches, 7⅝ inches, 8⅝ inches, 9⅝ inches (as with casing pipe 364), 10¾ inches, 13⅜ inches (as with casing pipe 362), and 14 inches.

The size (e.g., width, length) of the casing 360 can be based on the information gathered using field equipment 130 with respect to the wellbore 120 in the subterranean formation 110. The walls of the casing 360 have an inner surface that forms a cavity 308 that traverses the length of the casing 360. The casing 360 can be made of one or more of a number of suitable materials, including but not limited to steel. In certain example embodiments, the casing 360 is set along substantially all of the length of the wellbore 120. In order to extract production fluid from the reservoir in the formation 110, one or more of a number of perforations can be made in the casing 360. Such perforations allow the production fluid to enter the cavity 308 from a reservoir in the formation 110 adjacent to the perforations. The perforations can be made using one or more of a number of perforating technologies currently used or to be discovered with respect to a field operation.

The tubing (e.g., tubing 310, tubing 315, tubing 320) (sometimes called a tubing string and/or a tubular) can include a number of tubing pipes (e.g., tubing pipe 381, tubing pipe 383, tubing pipe 386, tubing pipe 387, tubing pipe 391, tubing pipe 393, tubing pipe 396, tubing pipe 397) (also called tubing pipe members) that are mechanically coupled to each other end-to-end, usually with mating threads. The tubing pipes of a tubing string (for example, tubing pipe 381, tubing pipe 383, tubing pipe 386, and tubing pipe 387 for tubing string 320, and tubing pipe 391, tubing pipe 393, tubing pipe 396, tubing pipe 397 for tubing string 310) can be mechanically coupled to each other directly or using a coupling device, such as a coupling sleeve. As in this case, more than one tubing string can be disposed within a cavity 308 of the casing 360.

Each tubing pipe of a tubing string can have a length and a width (e.g., outer diameter). The length of a tubing pipe can vary. For example, a common length of a tubing pipe is approximately 30 feet. The length of a tubing pipe can be longer (e.g., 40 feet) or shorter (e.g., 10 feet) than 30 feet. The width of a tubing pipe can also vary and can depend on one or more of a number of factors, including but not limited to the inner diameter of the casing pipe. For example, the width of the tubing pipe is less than the inner diameter of the casing pipe. The width of a tubing pipe can refer to an outer diameter, an inner diameter, or some other form of measurement of the tubing pipe. Examples of a width in terms of an outer diameter can include, but are not limited to, 7 inches, 5½ inches (as with tubing 320), 4 inches, and 2⅞ inches (as with tubing 310 and tubing 315).

The distal end of the tubing 315 can be located toward the bottom of the wellbore 120, and the proximal end of the tubing 315 can be located closer to the surface 102. In certain example embodiments, the distal end of the tubing 315 is open (substantially unobstructed) and is positioned within the cavity 308 of the wellbore 120. In such a case, the casing 360 can extend further into the wellbore 120 than some or all of the tubing (in this case, for example, tubing 310 and tubing 320).

The size (e.g., outer diameter, length) of the tubing can be determined based, in part, on the size of the cavity 308 within the casing 360 and/or the configuration of the multiple connection bushing 330. The walls of the tubing have an inner surface that each forms a cavity. For example, the inner surface 312 of tubing 310 forms a cavity 316 that traverses the length of the tubing 310, and the inner surface of tubing 315 forms a cavity 317 that traverses the length of the tubing 315. The tubing can be made of one or more of a number of suitable materials, including but not limited to steel. The one or more materials of the tubing can be the same or different than the materials of the casing 360.

In certain example embodiments, the size of the tubing 320 (also called the outside tubing) is larger than the size of the tubing 310 (also called the inside tubing). For example, the tubing 320 can have an inner diameter (defined by inner surface 322) that is larger than the outer diameter (defined by outer surface 314) of the tubing 310. As a specific example, the tubing 310 can have an inner diameter of 3.5 inches and an outer diameter of 3.961 inches, while the tubing 320 can have an inner diameter of 4.611 inches and an outer diameter of 5.5 inches. In such a case, when the tubing 310 is positioned inside of the tubing 320, the tubing 310 (the inside tubing) is said to be concentric with tubing 320 (the outside tubing), and a space 340 is formed between the outer surface 314 of the tubing 310 and the inner surface 322 of the tubing 320. The size (e.g., inner diameter, outer diameter) of the tubing 310 can be substantially the same as, or different than, the size of the tubing 315.

The multiple connection bushing 330 is a device that has a number (e.g., three) of coupling features that allow the multiple connection bushing 330 to mechanically couple to multiple sizes of tubing (e.g., tubing 310, tubing 315, tubing 320) at one time. For example, the multiple connection bushing 330 can include a bottom coupling feature 333 that mechanically couples to the proximal end of the tubing 315. As another example, the multiple connection bushing 330 can include a top coupling feature 331 that mechanically couples to the distal end of the tubing 310. As still another example, the multiple connection bushing 330 can include another top coupling feature 332 that mechanically couples to the distal end of the tubing 320.

Each coupling feature of the multiple connection bushing 330 can be any type of coupling feature that complements the coupling feature of the respective tubing to which the multiple connection bushing 330 attaches. Examples of such coupling features can include, but are not limited to, mating threads, slots, and compression fittings. The multiple connection bushing 330 can include an inner surface 334 and an outer surface 336 and have a generally cylindrical shape. The inner surface 334 can form a passage that traverses the length of the multiple connection bushing 330. The multiple connection bushing 330 can be made of one or more of a number of suitable materials, including but not limited to steel. In such a case, when a tubing is mechanically coupled to the multiple connection bushing 330, the tubing and the multiple connection bushing 330 form a tight seal that is substantially impervious to the passage of fluids or gases.

In certain example embodiments, one or more of a number of slips 200 are disposed between the tubing 310 and the tubing 320. Each slip 200 can be tubular in shape (wrapping around tubing 310), segmented, or have any of a number of other shapes and/or configurations. Each slip 200 can have one or more features (e.g., slots that traverse its height, a lattice structure) that allow air to flow therethrough. As such, when a slip 200 is positioned in the space 340 between the tubing 310 and the tubing 320, there is no pressure differential between one side (e.g., the top side) of the slip 200 and the other side (e.g., the bottom side) of the slip 200.

As shown in FIG. 2 above, each slip 200 can have opposing grip elements. For example, when the slip 200 is disposed between the pipe 310 and the pipe 320, the grip elements disposed on the inner surface of the slip 200 prevent a downward movement of the pipe 310, and the grip elements disposed on the outer surface of the slip 200 can prevent an upward movement of the pipe 320. Using the opposing grip elements of the slip 200, the piping 310 can be held under tension as the piping 310 is run into the wellbore 120. As a result, high tensile stresses are captured in the piping 310, and the piping 310 can expand into a relaxed state when the piping 310 is heated.

For example, working fluid can be injected by the injection device 307 through the cavity formed by the cavity 316 of the tubing 310, the passage 318 through the multiple connection bushing 330, and the cavity 317 of the tubing 315. The working fluid can have a substantially high temperature. For example, the temperature of the working fluid can be approximately 750° F. When this occurs, the temperature of the tubing 310 can also approach approximately 750° F.

If a vacuum is created in the space 340 between the tubing 310 and the tubing 320, then the vacuum acts as an efficient insulator in the space 340. Thus, the vacuum created in the space 340 can cause significant temperature differences between the tubing 310 and the tubing 320 as high-temperature working fluid is injected into the wellbore 120 through the cavity formed, in part, by the cavity 316 of the tubing 310 and by the cavity 308. As an example, if the temperature of the tubing 310 is approximately 750° F., the temperature of the tubing 320 can be approximately 150° F. As another example, if the temperature of the tubing 310 is approximately 650° F., the temperature of the tubing 320 can be approximately 350° F. In any case, the temperature of the tubing 310 is higher, to some extent, than the temperature of the tubing 320.

Thus, because of the thermal properties of the tubing 320 and the tubing 310, the tubing 310 would expand at a significantly higher rate than the tubing 320 because of the relatively high temperature of the tubing 310. Consequently, if the tubing 310 is put under tension as the tubing 310 is installed, then the tubing 310 can expand into a relaxed state when the tubing 310 is exposed to high temperatures. By using slips 200 to put the tubing 310 under tension, there is no need for special equipment or flexible configuration to allow for expansion of the tubing 310 at or near the surface 102. The process of installing tubing under tension is described in greater detail in connection with FIG. 4 herein.

Each slip 200 can be located a certain distance (e.g., 500 feet, 1,000 feet) from each other. The distance between two slips 200 can be the same or different than the distance between other slips 200 in the system 300. The distance between two adjacent slips 200 can be based, at least in part, on the weight rating of the tubing (e.g., tubing pipe for tubing 310) and the weight of the tubing (i.e., tubing 315, tubing 310, tubing 320) that is positioned downhole. The piping 310 and the piping 320 between two adjacent slips 200 can create a section of piping. For example, the first two slips 200 located above the multiple connection bushing 330 in the wellbore 120 form a section 301 of piping 310 and piping 320. Immediately adjacent to section 301, formed by the second and third slips 200 from the multiple connection bushing 330, is section 302 of piping 310 and piping 320. Section 309 of piping 310 and piping 320 in FIG. 3 is formed by the two slips located closest to the surface 102.

The slip 200 can be made of one or more of a number of thermally non-conductive materials, including but not limited to ceramic, plastic, and rubber. In certain example embodiments, each slip 200 is used to provide physical separation between the tubing 310 and the tubing 320. The slip 200 can be rigid or somewhat elastic. The width of a slip 200 can be substantially the same as, or less than, the width (e.g., one inch, one-half inch) of the space 340 between the tubing 310 and the tubing 320.

Optionally, in addition, in certain example embodiments, one or more of a number of centralizers 350 are disposed between the tubing 310 and the tubing 320. Each centralizer 350 can be tubular in shape (wrapping around tubing 310), segmented, or have any of a number of other shapes and/or configurations. Each centralizer 350 can have one or more features (e.g., slots that traverse its height, a lattice structure) that allow air to flow therethrough. As such, when a centralizer is positioned in the space 340 between the tubing 310 and the tubing 320, there is no pressure differential between one side of the centralizer 350 and the other side of the centralizer 350.

Unlike the slip 200, the centralizer 350 can lack one or both sets of grip elements. In addition, or in the alternative, a grip element on the centralizer 350 can be oriented differently than a grip element on the slip 200. For example, a grip element positioned on the inner surface of the centralizer 350 can be oriented to prevent upward movement of the pipe 310.

The centralizer 350 can be made of one or more of a number of thermally non-conductive materials, including but not limited to ceramic, plastic, and rubber. In certain example embodiments, each centralizer 350 is used to provide physical separation between the tubing 310 and the tubing 320. The centralizer 350 can be rigid or somewhat elastic. The width of a centralizer 350 can be substantially the same as, or less than, the width (e.g., one inch, one-half inch) of the space 340 between the tubing 310 and the tubing 320.

Optionally, if the space 340, formed between the tubing 310, the tubing 320, and the multiple connection bushing 350 is being controlled (e.g., create a vacuum in the space 340), the space 340 can be enclosed at or near the surface 102 by the spacer wellhead spool 380 and a vacuum system 385. The spacer wellhead spool 380 (also called a spacer wellhead bowl 380) is used to secure (in this case, seal) the upper end of the space between the tubing 310 and the tubing 320. The size and pressure rating of the spacer wellhead spool 380 can vary based on one or more of a number of factors, including but not limited to the size of the tubing 310, the size of the tubing 320, and the maximum or minimum pressure in the space 340 created by the vacuum system 385.

The vacuum system 385 can include one or more components that are used to create a vacuum or otherwise control the pressure in the space 340. For example, the vacuum system 385 can include a vacuum pump, piping, and an access valve. The access valve can be mechanically coupled to the spacer wellhead spool 380 and provide access to the space 340 by the rest of the vacuum system 385. In other words, the access valve 384 allows the vacuum system 385 to be communicably and removably coupled to the space 340. The vacuum pump can include a motor, a pump, and/or any other equipment to enable the vacuum pump to create a vacuum or otherwise control the pressure in the space 340. The vacuum pump and the piping can be sized and/or configured in a manner consistent with the operating parameters of the system 300.

In certain example embodiments, one or more components (e.g., a motor, a motorized valve) of the vacuum system 385 can operate using electricity. Such components of the vacuum system 385 can run, at least in part, using electric power fed from, for example, one or more cables 399. For example, the power source 303 can be electrically coupled to the vacuum system 385 using the cable 399. The power source 303 can deliver a constant or a variable amount of power to the vacuum system 385.

In addition, or in the alternative, the power cables 399 can provide power generated by the power source 303 to one or more other components of the system 300. The power source 303 can be any device (e.g., generator, battery) capable of generating electric power. Other components of the system 300 that can operate using electric power generated by the power source 303 can include, but are limited to, completion equipment 397 and an injection device 307, each described below. In certain example embodiments, the power source 303 is electrically coupled to one or more cables 399. In such a case, the cables 399 can be capable of maintaining an electrical connection between the power source 303 and one or more components of the system 300 when such components are operating.

The power generated by the power source 303 can be alternating current (AC) power or direct current (DC) power. If the power generated by the power source 303 is AC power, the power can be delivered in a single phase. The power generated by the power source 303 can be conditioned (e.g., transformed, inverted, converted) by a power conditioner (not shown) before being delivered to the component using a cable 399.

In certain example embodiments, completion equipment 397 can be disposed within the cavity 308. In some cases, the completion equipment 397 is located below the tubing 315 in the wellbore 120. The completion equipment 397 can include one or more of a number of components, including but not limited to a power conditioner, a motor, a pump, and a valve. For example, the completion equipment 397 can be a pump assembly (e.g., pump, pump motor) that can pump, when operating, oil, gas, and/or other production fluids from the wellbore 120 through the distal end of the tubing 315 and up the cavity 317 of the tubing 315, through the passage 318 of the multiple connection bushing 330, and up the cavity 316 of the tubing 310 to the surface 102.

One or more components of the completion equipment 397 can operate using electric power. In such a case, the completion equipment 397 can receive power from the power source 303 using a cable 399 that is run in the cavity 308 between the casing 360 and the outer surface 324 of the tubing 320. The power received by the completion equipment 397 can be the same type of power (e.g., AC power, DC power) generated by the power source 303. The power received by the completion equipment 397 can be conditioned (e.g., transformed, inverted, converted) into any level and/or form required by the completion equipment 397. In some cases, the completion equipment 397 can include a control system that controls the functionality of the completion equipment 397. Such a control system can be communicably coupled with a user and/or some other system so that the control system can receive and/or send commands and/or data.

In certain example embodiments, the cavity 308 is physically and/or thermally separated from the area in the wellbore 120 where the perforations are located so that the cavity 308 does not experience the same operating conditions as the area where the perforations are located. For example, one or more packers 388 can be installed in one or more locations in the wellbore 120. For example, a packer 388 can be positioned between the tubing 315 and some lower portion of the casing 360 (e.g., casing 364). As another example, as shown in FIG. 3, a packer 388 can be positioned between the tubing 315 and the wall of the wellbore 120. In any case, the packers 388 can have passages that traverse therethrough and allow one or more devices such as cables 399 to traverse the packers 388. In the case of cables 399, the cables 399 can traverse the packers 388 to electrically couple to the completion equipment 397 located toward the bottom of the wellbore 120 (or, at least, below the packers 388).

In certain example embodiments, the lower wellhead spool 370 (also called the lower wellhead bowl 370) and the upper wellhead spool 390 (also called the upper wellhead bowl 390) are similar to the spacer wellhead spool 380. In this case, the lower wellhead spool 370 can be used to secure the upper end of the casing 360 and/or the tubing 320. In addition, the upper wellhead spool 390 can be used to secure the upper end of the tubing 310. The size and pressure rating of the lower wellhead spool 370 and the upper wellhead spool 390 can vary based one or more of a number of factors, including but not limited to the weight of the tubing 310, the weight of the tubing 320, and the weight of the casing 360.

The optional Christmas tree 395 is an assembly of devices such as valves, spools, pressure gauges, and chokes that are fitted to the wellhead and are used to control extraction of the production fluid. The Christmas tree 395 can be located at or near the surface 102. The Christmas tree 395 can include, or be separate from, the injection device 307. If one or more devices of the Christmas tree 395 require electrical power to operate, then the power source 303 can be electrically coupled to the Christmas tree 395.

The injection device 307 can be separate from or part of the Christmas tree 395 and can be used to send the working fluid into the wellbore through the cavity formed by the cavity 316 of the tubing 310, the passage 318 through the multiple connection bushing 330, and the cavity 317 of the tubing 315. The injection device 307 can be located at or near the surface 102. The injection device 307 can be communicably coupled to the cavity formed by the cavity 316 of the tubing 310, the passage 318 through the multiple connection bushing 330, and the cavity 317 of the tubing 315.

In certain example embodiments, the injection device 307 can also process (e.g., pressurize, heat) the working fluid before the working fluid is injected into the wellbore 120. The processing and injection of the working fluid can occur using the same or different devices. To the extent that one or more components of the injection device 307 requires electrical power to operate, then the power source 303 can be electrically coupled to the injection device 307 using one or more cables 399.

Figure 4:
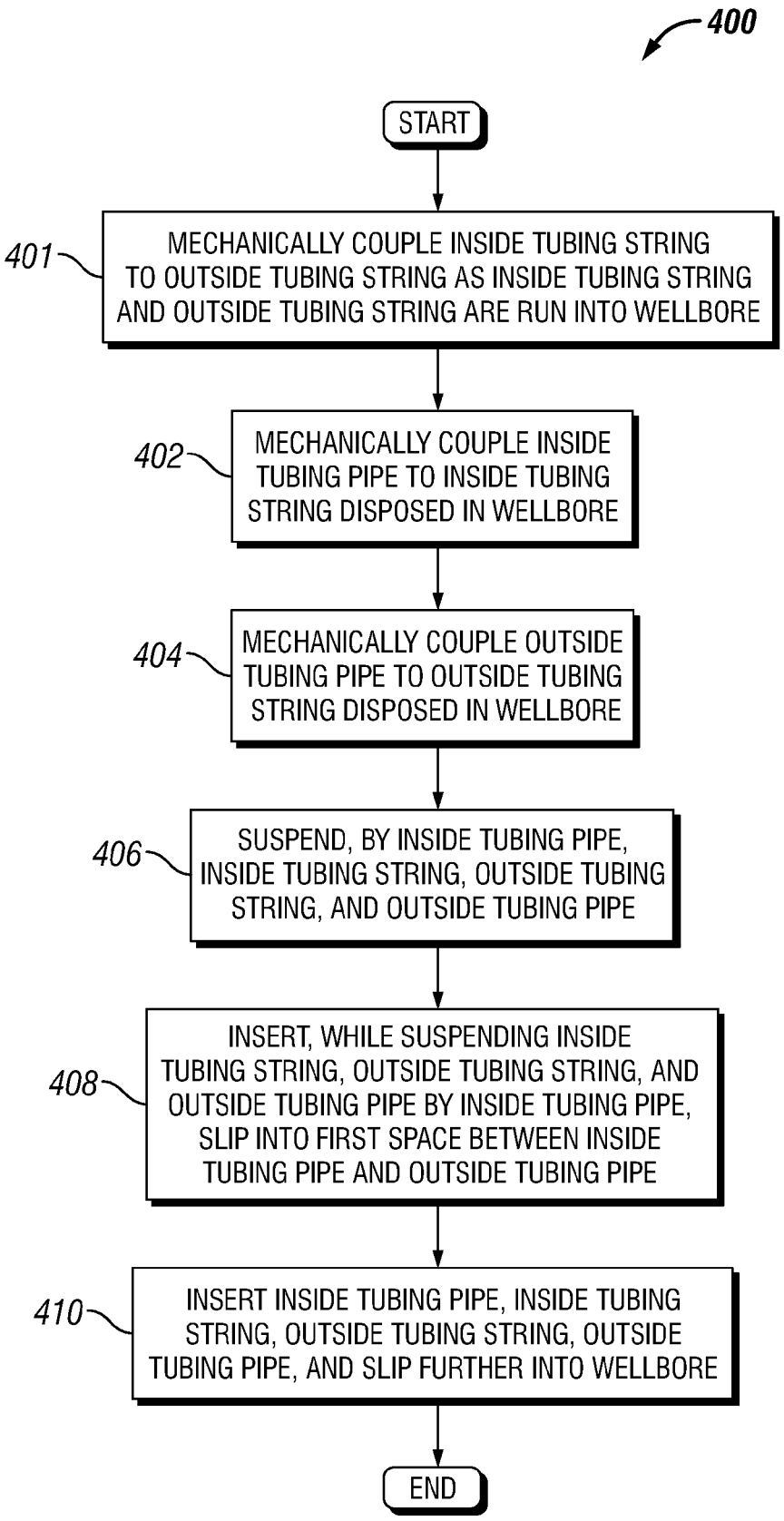
FIG. 4 shows a flowchart presenting a method for pre-tensing sections of concentric tubulars in a wellbore in accordance with certain example embodiments.

FIG. 4 is a flowchart presenting a method 400 for pretensing sections of concentric tubulars in a wellbore in accordance with certain example embodiments. While the various steps in this flowchart are presented and described sequentially, one of ordinary skill will appreciate that some or all of the steps may be executed in different orders, may be combined or omitted, and some or all of the steps may be executed in parallel. Further, in one or more of the example embodiments, one or more of the steps described below may be omitted, repeated, and/or performed in a different order. In addition, a person of ordinary skill in the art will appreciate that additional steps not shown in FIG. 4, may be included in performing this method. Accordingly, the specific arrangement of steps should not be construed as limiting the scope.

Referring now to FIGS. 1, 2, 3, and 4, the example method 400 begins at the START step and proceeds to step 401, where an inside tubing string 310 is mechanically coupled to an outside tubing string 320 as the inside tubing string 310 and the outside tubing string 320 are run into the wellbore 120. The first tubing string 310 and the second tubing string 320 can be mechanically coupled to each other by a multiple connection bushing 330 at a distal end in the wellbore 120. In such a case, the first tubing string 310 can be mechanically coupled to the first top coupling feature 331 of the multiple connection bushing 330 using field equipment 130, such as, for example, tongs, a clamping device, and a rotary table. The tubing 310 can be mechanically coupled to the first top coupling feature 331 of the multiple connection bushing 330 at or above the surface 102. In addition, the second tubing string 320 can be mechanically coupled to the second top coupling feature 332 of the multiple connection bushing 330 using field equipment 130, such as, for example, tongs, a clamping device, and a rotary table. The tubing 320 can be mechanically coupled to the second top coupling feature 332 of the multiple connection bushing 330 at or above the surface 102.

In step 402, an inside tubing pipe is mechanically coupled to the inside tubing string 310 disposed in the wellbore 120. Specifically, one or more pipes of tubing 310 can be mechanically coupled to (added to) tubing 310, increasing the length of the tubing string 310. As explained above, in certain example embodiments, the tubing 310 is a number of tubing members (or tubing pipes or tubing pipe members) that are mechanically coupled to each other on an end-to-end basis. The number of tubing pipes that make up the first tubing 310 can vary and depend on one or more of a number of factors, including but not limited to the size of the reservoir, the inclination of the wellbore 120, the weight of each tubing pipe, and the size of the wellbore where the reservoir is located in the wellbore 120.

In certain example embodiments, the inside tubing pipe is mechanically coupled to the first tubing string 310 using field equipment 130, such as, for example, tongs, a clamping device, and a rotary table. The inside tubing pipe can be mechanically coupled to the first tubing string 310 at or above the surface 102.

In step 404, an outside tubing pipe is mechanically coupled to an outside tubing string 320 disposed in the wellbore 120. Specifically, one or more pipes of tubing 320 can be mechanically coupled to (added to) tubing 320, increasing the length of the tubing string 320. As explained above, in certain example embodiments, the tubing 320 is a number of tubing members (or tubing pipes or tubing pipe members) that are mechanically coupled to each other on an end-to-end basis. The number of tubing pipes that make up the second tubing 320 can vary and depend on one or more of a number of factors, including but not limited to the size of the reservoir, the inclination of the wellbore 120, the weight of each tubing pipe, and the size of the wellbore where the reservoir is located in the wellbore 120.

In certain example embodiments, the tubing 320 has an inner diameter 322 that is greater than an outer diameter 314 of the tubing 310. In such a case, the first tubing 310 can be positioned inside a cavity of the second tubing 320 to form the space 340 between the first tubing 310 and the second tubing 320. The first tubing string 310 and the second tubing string 320 can be mechanically coupled to each other at a distal end of the wellbore 120 (or, at least, below the surface 102). In addition, or in the alternative, the tubing 320 can have an outer diameter 324 that is less than an inner diameter of the casing 260 inserted into the wellbore 120. The length of each first tubing member of the first tubing 220 can be the same or a different length of each second tubing member of the second tubing 210.

In certain example embodiments, the second tubing is mechanically coupled to the second tubing string 320 using field equipment 130, such as, for example, tongs, a clamping device, and a rotary table. The second tubing can be mechanically coupled to the second tubing string 320 at or above the surface 102.

In step 406, the inside tubing string 310, the outside tubing string 320, and the outside tubing pipe are suspended by the inside tubing pipe. In certain example embodiments, the inside tubing string 310, the outside tubing string 320, and the outside tubing pipe are suspended by a top end of the inside tubing pipe. Field equipment 130 (e.g., top drive, tongs) can be used to suspend the inside tubing string 310, the outside tubing string 320, and the outside tubing pipe. During this step 406, the outside tubing pipe (and, in some cases, at least part of the inside tubing string 310) are placed under tension because the inside tubing pipe (and, in some cases, at least part of the inside tubing string 310) are supporting the weight of the any reminder of the inside tubing string 310, the outside tubing string 320, and the outside tubing pipe. In essence, this stretches the inside tubing pipe (and, in some cases, at least part of the inside tubing string 310).

In certain example embodiments, the inside tubing string 310 can be disposed within the (and, in some cases, at least part of the inside tubing string 310) tubing string 320. In such a case, the top end of the inside tubing string 310 can extend further above the surface 102 than the top end of the outside tubing string 320. Similarly, the top end of the inside tubing pipe, when coupled to the inside tubing string 310, can extend further above the surface 102 than the top end of the outside tubing pipe when coupled to the outside tubing string 320. This allows the field equipment 130 to easily grasp the top end of the inside tubing pipe to suspend the inside tubing string 310, the outside tubing string 320, and the outside tubing pipe.

In step 408, while suspending the inside tubing string 310, the outside tubing string 320, and the outside tubing pipe by the inside tubing pipe, a slip 200 is inserted into the space 340 between the inside tubing pipe and the outside tubing pipe. In certain example embodiments, when the slip 200 is inserted into the space 340 between the inside tubing pipe and the outside tubing pipe, the slip 200 locks the inside tubing pipe and the outside tubing pipe in place relative to each other. In other words, the slip 200 keeps the inside tubing pipe (and at least a portion of the inside tubing string 310) under tension. The slip 200 can be inserted by hand by a user and/or using field equipment 130. Since the slip 200 has a number of passages that traverse its length, the space 340 above the slip 200 and the space 340 below the slip 200 form a continuous space 340. In other words, if a vacuum (or, conversely, a pressure) is created in the space 340, the vacuum (or a pressure) is substantially uniform in the space 340 from the surface 102 down to the multiple connector bushing 330.

In step 410, the inside tubing pipe, the inside tubing string 310, the outside tubing string 320, the outside tubing pipe, and the slip 200 are inserted further into the wellbore 120. In certain example embodiments, the inside tubing pipe, the inside tubing string 310, the outside tubing string 320, the outside tubing pipe, and the slip 200 are inserted further into the wellbore 120 using field equipment 130. The inside tubing pipe, the inside tubing string 310, the outside tubing string 320, the outside tubing pipe, and the slip 200 can be inserted into the wellbore 120 until a portion of the top end of the inside tubing pipe (now part of the inside tubing string 310) and the outside tubing pipe (now part of the outside tubing string 320) remain above the surface 102. Once step 410 is completed, the process ends with the END step.

If additional tubing needs to be added to extend the first tubing string 310 and the second tubing string 320 further into the wellbore 120, the method 400 can be repeated. In certain example embodiments, heat can be applied within a cavity 316 of the inside tubing pipe and the inside tubing string 310. For example, the space 340 between the multiple connection bushing 330, the inside tubing 310, and the outside tubing 320 can be depressurized using the vacuum system 385 to create a vacuum in the space 340. In such a case, the heat can expand the inside tubing pipe and, in some cases, at least a portion of the inside tubing string 310, which causes the tension in the inside tubing pipe and, in some cases, at least a portion of the inside tubing string 310 to decrease. Conversely, as the inside tubing pipe and any applicable portion of the inside tubing string 310 are cooled from a heated state, the tension in the inside tubing pipe and any applicable portion of the inside tubing string 310 returns as the lower temperature contracts the inside tubing pipe and the inside tubing string 310.

As discussed above, the vacuum created in the space 340 between the tubing 310 and the tubing 320 means that the tubing 310 can be subject to significantly higher temperatures than the tubing 320. Thus, in certain example embodiments, the tubing 310 can expand and contract with temperature independent of the expansion and contraction of the tubing 320. By pre-tensing the tubing 310, the independent expansion and contraction of the tubing 310 relative to the tubing 320 can be achieved. In such a case, the space 340 can remain pressurized when the tubing 310 expands and contracts.

The space 340 can be pressurized to any of a number (e.g., 3,300 psi) of constant or variable pressures. The amount of pressure in the space 340 can be controlled through the vacuum system 385 by a user, by an automated control system, and/or by some other means. In addition, the space 340 can be pressurized substantially uniformly along its length. As a result, the temperature of the tubing 320 can be substantially equal along its length and substantially lower than the temperature of the tubing 310, which greatly reduces the risk of damaging the casing 360 and/or the wellbore 120.

By performing the method 400 of FIG. 4, the vacuum-insulated tubing in the wellbore 120 can be used in one or more of a number of applications that requires isolating temperatures and/or creating a radial and/or horizontal temperature differential within a wellbore 120.

The systems, methods, and apparatuses described herein allow for pre-tensing sections of concentric tubulars in a wellbore using existing tubing. Example embodiments allow for the inner-most of the concentric tubing to expand, when exposed to heat, into a relaxed state. Thus, example embodiments can significantly reduce cost and maintenance of a production system (or other system or field operation in which example embodiments can be used) by not requiring extra equipment that would be required if the tubing rises vertically upward when exposed to high temperatures.

An example application in which example embodiments can be used is a vacuum that is created between the concentric tubulars and high-temperature working fluid that is inserted into the cavity of the inner-most tubing. In such a case, the slips used to maintain the inner-most tubing in tension allow for a vacuum that is continuous, rather than segmented when using currently available technology. The vacuum provides insulation so that the temperature of the components (e.g., casing) close to the wall of the wellbore (away from the radial center of the wellbore) are lower using example embodiments compared to using existing technology. Thus, there is a lower likelihood that high temperatures will compromise the wellbore where the working fluid passes.

In addition, using example embodiments, the inner-most tubing (i.e., the tubing through which the high-temperature working fluid is injected) can freely expand to a normal state and contract back into a state of tension, independent of the relatively minimal expansion and contraction of the outer tubing through which the inner-most tubing traverses. As a result, the working fluid can be injected into the wellbore at higher temperatures using example embodiments than it can using current technology. Thus, the viscosity of the production fluid can be further enhanced using example embodiments, making extraction of the production fluid easier and more cost-effective.

In addition to heating production fluid, the systems and methods described herein can be used in a number of other downhole applications. Specifically, the higher range of temperatures of the working fluid, the contiguousness of the vacuum, and/or the independent movement of the concentric tubulars can be used for one or more of a number of downhole applications within a wellbore. For example, systems and methods described herein can be used to cause a chemical reaction.

Although embodiments described herein are made with reference to example embodiments, it should be appreciated by those skilled in the art that various modifications are well within the scope and spirit of this disclosure. Those skilled in the art will appreciate that the example embodiments described herein are not limited to any specifically discussed application and that the embodiments described herein are illustrative and not restrictive. From the description of the example embodiments, equivalents of the elements shown therein will suggest themselves to those skilled in the art, and ways of constructing other embodiments using the present disclosure will suggest themselves to practitioners of the art. Therefore, the scope of the example embodiments is not limited herein.

What is claimed is:

1. A method for pre-tensing sections of concentric tubulars in a wellbore, the method comprising:

mechanically coupling an inside tubing string to an outside tubing string as the inside tubing string and the outside tubing string are run into the wellbore, wherein the inside tubing string comprises at least one inside tubing pipe, and wherein the outside tubing string comprises at least one outside tubing pipe;

mechanically coupling an additional inside tubing pipe to the inside tubing string disposed in the wellbore;

mechanically coupling an additional outside tubing pipe to the outside tubing string disposed in the wellbore, wherein the additional inside tubing pipe is positioned inside a first cavity of the additional outside tubing pipe to form a first space between the additional inside tubing pipe and the additional outside tubing pipe;

suspending, by the additional inside tubing pipe, the inside tubing string, the outside tubing string, and the additional outside tubing pipe;

inserting, while suspending the inside tubing string, the outside tubing string, and the additional outside tubing pipe by the additional inside tubing pipe, a first slip into the first space between the additional inside tubing pipe and the additional outside tubing pipe, wherein the first slip comprises at least one inner slip feature and at least one outer slip feature that prevent the additional inside tubing pipe from moving downward relative to the additional outside tubing pipe; and inserting the additional inside tubing pipe, the inside tubing string, the outside tubing string, the additional outside tubing pipe, and the first slip further into the wellbore, wherein the first slip holds the additional inside tubing pipe and the inside tubing string under tension when the additional inside tubing pipe, the inside tubing string, the outside tubing string, the additional outside tubing pipe, and the first slip are inserted into the wellbore, and wherein the tension in the additional inside tubing pipe and the inside tubing string decreases as heat within the wellbore expands the additional inside tubing pipe and the inside tubing string.

2. The method of claim 1, wherein the inside tubing string, the outside tubing string, and the additional outside tubing pipe are suspended by a top end of the additional inside tubing pipe.

3. The method of claim 1, wherein the inside tubing string and the outside tubing string are mechanically coupled to each other by a multiple connection bushing at the distal end in the wellbore.

4. The method of claim 1, wherein the additional inside tubing pipe and the inside tubing string are secured under tension by the first slip after inserting the first slip.

5. The method of claim 4, wherein the first slip further secures the additional outside tubing pipe and the outside tubing string.

6. The method of claim 1, further comprising:

applying the heat within a cavity of the additional inside tubing pipe and the inside tubing string, wherein the heat expands the additional inside tubing pipe and the inside tubing string.

7. The method of claim 6, further comprising:

removing the heat from within the cavity of the additional inside tubing pipe and the inside tubing string, wherein removal of the heat contracts the additional inside tubing pipe and the inside tubing string, and wherein the tension in the additional inside tubing pipe and the inside tubing string returns as the heat contracts the additional inside tubing pipe and the inside tubing string.

8. The method of claim 1, wherein the first slip comprises a plurality of passages that traverse its length.

9. The method of claim 1, further comprising:

mechanically coupling a subsequent additional inside tubing pipe to the additional inside tubing pipe disposed in the wellbore;

mechanically coupling a subsequent additional outside tubing pipe to the additional outside tubing pipe disposed in the wellbore, wherein the subsequent additional inside tubing pipe is positioned inside a second cavity of the subsequent additional outside tubing pipe to form a second space between the subsequent additional inside tubing pipe and the subsequent additional outside tubing pipe;

suspending, by the subsequent additional inside tubing pipe, the additional inside tubing pipe, the inside tubing string, the outside tubing string, the additional outside tubing pipe, and the subsequent additional outside tubing pipe;

inserting, while suspending the additional inside tubing pipe, the inside tubing string, the outside tubing string, the additional outside tubing pipe, and the subsequent additional outside tubing pipe by the subsequent additional inside tubing pipe, a second slip into the second space between the subsequent additional inside tubing pipe and the subsequent additional outside tubing pipe; and inserting the additional inside tubing pipe, the subsequent additional inside tubing pipe, the inside tubing string, the second outside string, the additional outside tubing pipe, the subsequent additional outside tubing pipe, the first slip, and the second slip further into the wellbore.

10. The method of claim 9, wherein the first space and the second space form a continuous space through the second slip.

11. The method of claim 9, wherein the second slip is separated from the first slip by a distance, wherein the distance is based on a weight of the additional inside tubing pipe, the inside tubing string, the subsequent additional inside tubing pipe, the outside tubing string, the additional outside tubing pipe, and the subsequent additional inside tubing pipe.

12. The method of claim 11, wherein the distance is 1,000 feet.

13. A system for pre-tensing sections of concentric tubulars, the system comprising:

an inside tubing string disposed, at least in part, within a wellbore, wherein the inside tubing string comprises at least one inside tubing pipe;

an outside tubing string disposed, at least in part, within the wellbore, wherein the inside tubing string is disposed inside of the outside tubing string, wherein the outside tubing string is mechanically coupled to the inside tubing string, wherein the outside tubing string has an inner diameter that is greater than an outer diameter of the inside tubing string, wherein the outside tubing string comprises at least one outside tubing pipe;

field equipment that detachably couples to a top end of the inside tubing string and suspends the inside tubing string and the outside tubing string; and at least one slip disposed between the inside tubing string and the outside tubing string while the field equipment suspends the inside tubing string and the outside tubing string, wherein the at least one slip comprises at least one inner slip feature and at least one outer slip feature, wherein the at least one slip holds the inside tubing string under tension when the field equipment releases the inside tubing string and the outside tubing string, wherein the at least one inner slip feature and the at least one outer slip feature prevents the inside tubing string from moving downward relative to the outside tubing string, wherein the tension in the inside tubing string decreases as heat within the wellbore expands the inside tubing string, and wherein the at least one slip is made of a first thermally non-conductive material.

14. The system of claim 13, further comprising:

a multiple connection bushing mechanically coupled to the distal end of the inside tubing string and the outside tubing string.

15. The system of claim 13, further comprising:

a casing disposed within the wellbore and comprising a plurality of perforations for receiving the production fluid from a reservoir adjacent to the plurality of perforations, wherein the outside tubing string has an outer diameter that is less than an inner diameter of the casing.

16. The system of claim 13, further comprising:

at least one centralizer disposed between the inside tubing string and the outside tubing string, wherein the at least one centralizer is made of a second thermally non-conductive material.

17. The system of claim 13, further comprising:

a vacuum system located proximate to a surface and communicably coupled to a space between the inside tubing string and the outside tubing string, wherein the vacuum system creates a vacuum in the space.

18. The system of claim 17, wherein the vacuum system comprises a vacuum pump.

19. The system of claim 13, further comprising:

an injection device that injects heated working fluid through a cavity of the inside tubing string, wherein heat from the working fluid expands the inside tubing string into a relaxed position.

20. The system of claim 13, further comprising:

an additional inside tubing pipe coupled to the inside tubing string using the field equipment; and an additional outside tubing pipe coupled to the outside tubing string using the field equipment.

* * * * *